United States Patent [19]

Koval

[11] 4,160,614

[45] Jul. 10, 1979

[54] EXPANSION SHELL ASSEMBLY AND METHOD FOR COMBINING RESIN BONDING AND MECHANICAL ANCHORING OF A BOLT IN A ROCK FORMATION

[75] Inventor: Stephen F. Koval, Portage, Pa.

[73] Assignee: Jennmar Corporation, Cresson, Pa.

[21] Appl. No.: 889,409

[22] Filed: Mar. 23, 1978

[51] Int. Cl.[2] ..... E21D 21/00

[52] U.S. Cl. ..... 405/259; 85/63

[58] Field of Search ..... 61/45 B, 63; 52/698, 52/704; 85/63, 81, 86, 87

[56] References Cited

U.S. PATENT DOCUMENTS

| | | | |
|---|---|---|---|
| 3,702,060 | 11/1972 | Cumming | 61/45 B |
| 3,877,235 | 4/1975 | Hill | 61/45 B |
| 3,896,627 | 7/1975 | Brown | 61/45 B |
| 3,940,941 | 3/1976 | Libert et al. | 61/45 B |
| 3,967,455 | 7/1976 | Conwag | 61/45 B |
| 4,051,683 | 10/1977 | Koval | 61/45 B |

*Primary Examiner*—Dennis L. Taylor

*Attorney, Agent, or Firm*—Stanley J. Price, Jr.; John M. Adams

[57] ABSTRACT

One or more breakable cartridges containing a two component resin system are inserted in a bore hole drilled in a rock formation by an elongated roof bolt. An expansion shell assembly is positioned on the end of the bolt and includes a shell formed by a plurality of bendable fingers surrounding a camming plug. The camming plug is threadably engaged to the end of the bolt. A clip member is non-rotatably secured to the shank of the bolt and extends into one of the longitudinal slots that separates the fingers of the shell. After the cartridges and bolt are advanced into the bore hole, the cartridges are compressed between the end of the bore hole and the end of the bolt and fractured to release the resin components. The clip member non-rotatably secures the shell to the bolt and prevents relative rotation between the camming plug and the bolt so that the bolt may be rotated in a counterclockwise direction to effect mixing of the resin components in the bore hole before the shell is expanded without threading the plug off the end of the bolt. The mixed resin flows downwardly in the bore hole and fills the voids between the shell and the wall of the bore hole. Before the resin hardens the bolt is rotated in a clockwise direction to disengage the clip member from the shell to permit downward advancement of the camming plug on the bolt to expand the shell. The cured resin filler increases the engagement of the shell with the wall of the bore hole and thereby reduces the slippage of the expanded shell in the bore hole to thus maintain the tension on the bolt.

13 Claims, 9 Drawing Figures

EXPANSION SHELL ASSEMBLY AND METHOD FOR COMBINING RESIN BONDING AND MECHANICAL ANCHORING OF A BOLT IN A ROCK FORMATION

BACKGROUND OF THE INVENTION

1. Field of the Invention

This invention relates to an expansion shell assembly and method for anchoring a roof bolt in a bore hole containing resin material and more particularly to an expansion shell assembly adapted for use with resin material to reduce slippage of the assembly in the bore hole and thereby maintain the tension on the bolt.

2. Description of the Prior Art

In underground operations, such as mining or excavating, the unsupported rock formation is supported by bolt members that are inserted in a bore hole drilled in the rock formation and are secured thereto by engagement of an expansion shell on the end of the bolt with the rock formation. A roof plate is retained on the end of the bolt that extends from the bore hole and abuts the roof. Rotating the bolt having an expansion shell positioned on an opposite end thereof expands the shell to engage the rock wall of the bore hole. The bolt is tensioned with the resultant effect of compressing the rock strata and thereby reinforcing the strata to resist forces that apply shear stresses to the rock formation. However, in soft rock strata over a period of time slippage occurs of the expanded shell in the bore hole. Consequently the tension on the bolt reduces, and the roof support provided by the bolt is decreased.

Supporting a rock formation by adhesively bonding an elongated bolt in a bore hole is illustrated and described in U.S. Pat. Nos. 3,324,662 and 3,394,527 and includes adhesively bonding the bolt in position by a thermosetting resin composition having thixotropic properties. The resin composition includes principally two components, a polyester resin and a catalyst, that are separately retained in a cartridge. One or more cartridges are suitably positioned in the bore hole and are fractured by upward movement of the rod which is rotated to intimately admix the components to form an essentially homogeneous curable resin mixture. The resin mixture polymerizes at ambient temperature and penetrates into the surrounding rock formation to adhesively unite the rock strata and to firmly hold the bolt in position in the bore hole. The resin mixture fills the annulus between the bore hole and the rod along a substantial length of the rod.

The principal disadvantage of the mechanical roof bolt apparatus is that contact between the roof bolt and the rock formation is confined to engagement of a relatively narrow portion of the fingers of the shell with the bore hole wall. Thus when the bolt is rotated to tension the bolt and compress the rock strata, particularly in soft strata, a loss in tension results due to slippage of the expanded shell in the bore hole. U.S. Pat. No. 3,702,060 discloses an expansion shell assembly that includes a resin container which is fixed to the end of the expansion shell and is ruptured upon actuation of the expansion shell to mix the components. The mixed components flow downwardly in the shell and are confined to the area immediately around the shell where the material reinforces the local rock strata and bonds the shell to the strata. The bolt is rotated until it reaches 80% of the final tension before the cured resin prevents further rotation of the bolt. When the resin is fully cured, a nut on the end of the bolt opposite the roof plate is rotated to bring the roof plate to its fully seated position against the mine roof to fully tension the bolt.

U.S. Pat. No. 3,188,815 discloses an anchor bolt assembly in which the tip of the bolt is cemented to the bottom of the drill hole by means of a plastic or cement mixture. The cement is mixed by driving in and rotating the bolt. An expanding wedging element is spaced from the tip of the bolt and is sealed in the bore hole from the mixed cement by a sealing disc which prevents the cement from contacting the wedge. After mixing the cement, further rotation of the bolt expands the wedge to tension the bolt. U.S. Pat. Nos. 3,222,873 and 3,695,045 disclose bonding anchor bolts, rods and the like to the wall of a bore hole by a resin mixture in which an expansion shell is utilized to hold the bolt in place until the resin cures without tensioning the bolt.

U.S. Pat. Nos. 3,877,235 and 4,051,683 disclose mine roof support devices that include elongated bolt members adhesively secured in the bore hole be a suitable resin material. In the former patent, mixed and hardened adhesive material non-rotatably secures a hollow pipelike anchor member in the bore hole. A bolt member is rotatably advanced through the anchor until a bearing plate is moved into contact with the mine roof and the bolt is tensioned. In the latter patent, a rod member is anchored in the bore hole by a resin material and is connected by a coupling to a bolt that includes a bearing plate on one end of the bolt opposite the mine roof. When the resin cures and the rod is bonded to the rock formation, further rotation of the bolt through the coupling advances the bolt upwardly in the bore hole to tension the bolt having the roof plate abutting the mine roof.

It has been suggested by the prior art devices to support a rock formation, such as a mine roof, by mechanically supporting bolts within the bore holes and/or adhesively bonding the bolts to the rock formation. The mechanically anchored roof bolt is susceptible to a loss of tension in the bolt by slippage of the expansion shell in the bore hole. The adhesively bonded bolt is not capable of being tensioned. Therefore, there is need for an expansion shell assembly that is operable for use with adhesive material to prevent slippage of the expansion shell in the bore hole and thereby maintain tension on the bolt.

SUMMARY OF THE INVENTION

In accordance with the present invention there is provided an expansion shell assembly for anchoring a bolt in a bore hole containing adhesive material in which a camming plug is threadably engaged to the end of the bolt for advancement thereon. An expandable shell surrounds the camming plug on the bolt and includes a plurality of longitudinally extending fingers spaced from one another by longitudinal slots. Each finger has an inner surface abutting the camming plug and an outer surface adapted to engage the wall of the bore hole. A releasable device is provided for securing the camming plug to the bolt for rotating the bolt in a first direction to facilitate mixing of the adhesive material in the bore hole. The releasable device is operable upon rotation of the bolt in a second direction to permit rotation of the bolt relative to the camming plug and effect advancement of the camming plug on the bolt to exert an outward force upon the inner surfaces of the fingers to expand the fingers in the bore hole.

Preferably, the expansion shell assembly is adapted for insertion in a bore hole drilled in a rock formation, such as a mine roof, to support the rock formation that overlies the mine roof. The expansion shell assembly is positioned on the end of the bolt and is advanced to adjacent the end of the bore hole. A bearing plate is retained on the opposite end of the bolt that extends from the bore hole. Prior to insertion of the bolt with the expansion shell assembly positioned thereon, a suitable adhesive material is positioned in the bore hole. The adhesive material, preferably, comprises a two component resin composition. The first component is a suitable resin having thixotropic properties to permit placement in vertical holes, such as in the roof of an underground mine. The second component is a suitable catalyst and the components are separately confined within a cartridge. Any number of such cartridges are inserted in tandem relation in the upper portion of the bore hole by the bolt.

The bolt with the expansion shell positioned on one end and the bearing plate positioned on the opposite end is thrust upwardly in the bore hole to fracture the cartridges. The resin components interact, and the bolt is rotated to mix the components to form a curable resin mixture that flows downwardly in the bore hole and particularly between the expansion shell and the wall of the bore hole.

Preferably, the bolt is rotated in a counterclockwise direction to effect mixing of the resin components. During the counterclockwise rotation of the bolt, the camming plug is prevented from threadably advancing off the end of the bolt by the releasable device securing the camming plug to the bolt.

Preferably, the releasable device is a clip member having a resilient portion releasably engageable with the shank of the bolt. A hook portion extends upwardly from the resilient portion and inwardly into one of the longitudinal slots separating adjacent fingers of the expansion shell. The resilient portion is substantially semicircular in shape and is provided with apertures arranged to receive protrusions on the shank of the bolt in such a manner to non-rotatably secure and axially fix the resilient portion to the bolt shank.

The end of the clip hook portion that extends into a longitudinal slot between adjacent fingers has a first or abutment portion that extends transversely relative to the adjacent side edge of one of the fingers and an opposite second or camming portion positioned adjacent the side edge of the opposite finger. Rotation of the bolt in a counterclockwise direction moves the abutment portion into abutting relation with the side edge of the adjacent finger. In this manner the clip member becomes engaged to the shell so that the shell remains non-rotatable on the threaded end of the bolt to prevent the camming plug from rotating relative to the bolt. By preventing relative rotation between the bolt and the camming plug, the camming plug is prevented from threading off the end of the bolt when the bolt is rotated in a counterclockwise direction during mixing of the resin components in the bore hole.

When mixing of the resin components is completed and prior to curing of the mixture, the bolt is rotated in a clockwise direction to effect expansion of the shell in the bore hole. When the bolt is rotated in a clockwise direction, the camming portion of the clip member is urged into contact with the side edge of the adjacent finger and moves relative thereto as the bolt rotates. Movement of the camming portion on the side edge of the finger ejects the hook portion of the clip member from the slot between fingers to disengage the clip member from the shell. This permits the bolt to rotate relative to the camming plug and the camming plug to expand the shell upon further clockwise rotation of the bolt in the bore hole.

When the camming plug is advanced downwardly to a location on the bolt where the shell is frictionally engaged to the wall of the bore hole and further movement of the camming plug is prevented, continued rotation of the bolt moves the bearing plate into abutting relation with the face of the rock formation and the bolt is tensioned. A substantial portion of the voids between the shell and the bore hole wall are filled with the resin. Thus by the addition of the resin filler slippage of the shell is substantially reduced to maintain a greater tension on the bolt, particularly for a soft strata rock formation.

Further, the present invention is directed to a method for supporting a rock formation that includes the steps of inserting an adhesive material in a bore of a rock formation. An elongated bolt member having an expansion shell assembly positioned on the end of the bolt member is advanced into the bore hole. The bolt member is rotated in a first direction to effect mixing of the adhesive material in the bore hole. Thereafter, the bolt member is rotated in a second direction to effect expansion of the expansion shell assembly in the bore hole to tension the bolt member and thereby securely anchor the bolt member to the rock formation.

Accordingly, the principal object of the present invention is to provide for a mine roof support system, a method and apparatus for maintaining the tension on a bolt secured in a rock formation by an expansion shell assembly by the addition of adhesive material between the expansion shell assembly and the bore hole wall to prevent slippage of the assembly in the bore hole.

Another object of the present invention is to provide a method and apparatus for anchoring a bolt in a bore hole by the addition of a resin system, which is positioned in surrounding relation with an expansion shell assembly and mixed by rotation of the bolt prior to the expansion of the shell assembly in the bore hole wall.

A further object of the present invention is to provide a method and apparatus for anchoring a roof bolt in a bore hole by combining the advantages of an expansion shell and resin bonding to prevent a loss in tension of the bolt and increase the area of engagement with the bore hole wall.

These and other objects of the present invention will be more completely disclosed and described in the following specification, accompanying drawings and the appended claims.

BRIEF DESCRIPTION OF THE DRAWINGS

FIG. 8-B is a sectional view similar to FIG. 8-A, illustrating rotation of the bolt in a second direction to effect disengagement of the clip member from the shell to permit relative rotation between the camming plug and the bolt for expansion of the shell in the bore hole after mixing of the adhesive material.

DESCRIPTION OF THE PREFERRED EMBODIMENT

Figure 1:
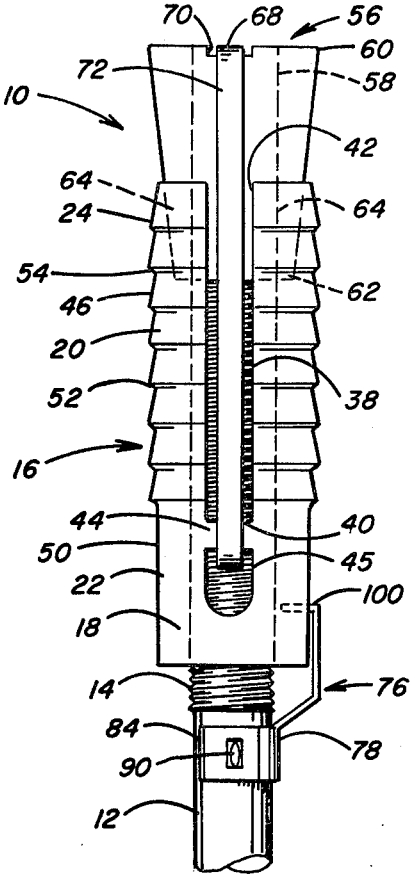
FIG. 1 is a fragmentary view in side elevation of an expansion shell assembly positioned on the threaded end of an elongated bolt, illustrating a clip member non-rotatably engaged to the shank of the bolt and extending upwardly into a longitudinal slot between a pair of fingers of the expansion shell.
Figure 2:
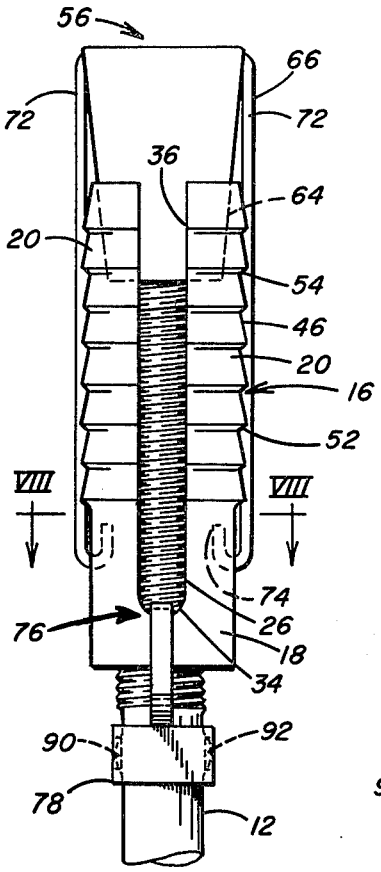
FIG. 2 is a fragmentary view in side elevation of the expansion shell assembly shown in FIG. 1, illustrating the clip member extending into the longitudinal slot separating a pair of fingers in a manner to prevent relative rotation between a camming plug and the bolt when the bolt is rotated in a first direction and to permit relative rotation between the camming plug and the bolt when the bolt is rotated in a second direction.
Figure 3:
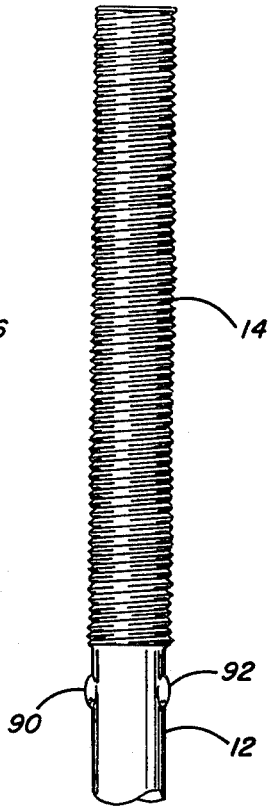
FIG. 3 is a fragmentary view in side elevation of the threaded end of the elongated bolt upon which the expansion shell assembly is positioned, illustrating a pair of protrusions on the shank of the bolt for non-rotatably securing the clip member to the bolt.
Figure 4:
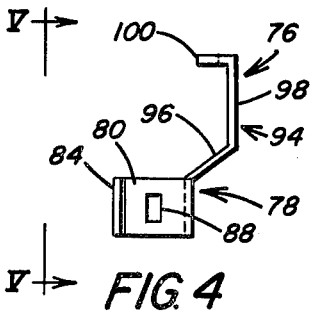
FIG. 4 is a view in side elevation of the clip member shown in FIGS. 1 and 2, illustrating the upwardly extending hook portion for engaging the expansion shell.
Figure 5:
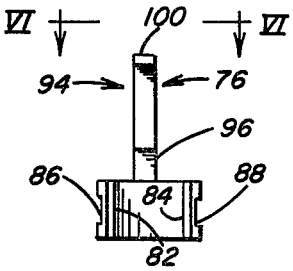
FIG. 5 is a view of the clip member taken along line V—V of FIG. 4.

Referring to the drawings and particularly to FIGS. 1-3, there is illustrated an expansion shell assembly generally designated by the numeral 10 for securing a bolt 12 in a bore hole (not shown) drilled in a rock formation to support a rock formation, that overlies an underground excavation, a mine passageway or the like. The bolt 12 has a threaded end portion 14 which is positioned in the upper portion of the bore hole. The bore hole is drilled to a preselected length in the rock formation as determined by the load bearing properties to be provided by the expansion shell assembly 10 and the bolt 12. The bolt 12 has an enlarged opposite end (not shown) which extends from the open end of the bore hole. A roof or bearing plate (not shown) is suitably retained on the enlarged end of the bolt. Once the bolt is secured by the expansion shell assembly 10 in the bore hole in a manner to be described later in greater detail, rotation of the bolt preferably in a clockwise direction urges the roof plate into abutting relation with the surface of the rock formation surrounding the open end of the bore hole. The bolt is rotated until a preselected tension is applied to the bolt with the result that the rock strata comprising the rock formation is compressed to resist forces that normally apply shear stresses to the rock formation and thus support the rock formation and particularly a mine roof that overlies a mine passageway.

The expansion shell assembly 10 includes a shell member generally designated by the numeral 16 which may be of the type well known in the art. The shell member 16 includes a solid ring end portion 18 and a plurality of longitudinally extending fingers 20 that extend axially from the ring end portion 18 and concentric with the ring end portion 18. Each of the fingers 20 has a lower end portion 22 connected to the ring end portion 18 and an upper end portion 24. A first pair of oppositely positioned longitudinal slots 26 and 28 divide the shell into two halves generally designated by the numerals 30 and 32, as illustrated in the FIGS. 8-A and 8-B. Each of the slots 26 and 28, as illustrated in FIG. 2, has a closed end portion 34 adjacent the shell ring end portion 18 and an open end portion 36 at the upper end portion 24 of adjacently positioned fingers 20.

Each shell half 30 and 32 includes a pair of fingers 20 that are separated by a longitudinally extending slot 38, illustrated in FIG. 1, having a length shorter than the slots 26 and 28. Each of the slots 38 has a closed end portion 40 spaced from the shell ring end portion 18 and an open end portion 42 positioned oppositely of the upper end portions 24 of the adjacent pairs of fingers 20. The closed end portion 40 of each slot 38 is formed by a connecting arrangement, such as a transverse member 44, which extends transversely to the longitudinal slot 38. The transverse member 44 connects adjacent pairs of fingers 20 in each shell half 30 and 32. The transverse member 44 is spaced longitudinally from the ring end portion 18 by an aperture 45.

The shorter longitudinal slots 38 and the transverse members 44 are diametrically opposed on the shell member 16, and the aperture 45 of shell half 30 is diametrically opposed from the aperture 45 of shell half 32. Thus with this arrangement shell member 16 is provided with four fingers 20 equally spaced about the circumference of the shell member 16. The four fingers 20 are divided into pairs, with one pair of fingers comprising shell half 30 and another pair of fingers comprising shell half 32.

The adjacent fingers 20 of each pair of fingers are separated by the shorter longitudinal slot 38 and connected by a transverse member 44. Accordingly, the two pairs of fingers are separated from one another by the longitudinal slots 26 and 28. With this arrangement as explained in greater detail in United States Patent Application Ser. No. 887,499 the individual fingers of each shell half 30 and 32 have a greater resistance to bending than the shell halves 30 and 32 as units because the ends of the slots 38 are spaced a greater distance from the ring end portion 18 than the slots 26 and 28 which terminate at the ring end portion 18. This arrangement facilitates uniform expansion of the shell halves into engagement with the bore hole wall before the individual fingers of the shell expand.

Each finger 20 includes an outer gripping surface 46 and an inner smooth surface 48. The outer surface 46 includes a first planar portion 50 that extends upwardly a preselected distance from the ring end portion 18. A gripping portion 52 of the finger outer surface 46 extends from the planar portion 50 to the finger upper end portion 24. The gripping portion 52 of each finger 20 includes a series of spaced parallel, tapered horizontal grooves 54. The grooves 54 form a series of downwardly extending serrations that are operable upon expension of the shell member 16 to engage the wall of the bore hole as the fingers 20 of the shell member 16 bend outwardly.

The gripping portion 52 of each finger 20 is urged into contact with the wall of the bore hole by a camming plug or wedge generally designated by the numberal 56. The camming plug 56 includes a threaded axial bore 58 threadably engaged to the threaded end portion 14 of bolt 12. The camming plug 56 has a tapered configuration with an enlarged upper end portion 60 and a reduced lower end portion 62. The inner surface 48 of each finger 20 abuts a tapered planar surface 64 of the camming plug 56.

The camming plug 56 and the shell member 16 are maintained in assembled relation on the threaded end of the bolt 12 prior to anchoring the assembly in a bore hole by a yieldable strap or bail 66. The strap 66 includes a bridge portion 68 that extends across the top and in overlying relation with the plug upper end portion 60. The bridge portion 68 is positioned in aligned recesses 70 that extend transversely to a longitudinal axis of the camming plug 56 on the upper end portion 60 thereof. This arrangement restrains strap 66 from sliding off the end of the camming plug 56.

The strap 66 includes leg portions 72 that extend downwardly from the strap bridge portion 68 on opposite sides of the shell member 16. The leg portions 72 extend parallel to the fingers 20 and are positioned in the opposed pair of slots 38. The leg portions 72 terminate in in-turned end portions 74. The end portions 74 are bent at an angle of substantially 180° relative to the leg portions 72 and extend through the apertures 45 and around the lower edge of the transverse members 44 and into engagement with the inner surface of the transverse members 44. With this arrangement the strap 66 is engaged to the shell member 16 to maintain the camming plug 56 assembled within the shell member 16.

An attachment generally designated by the numeral 76 is provided to prevent relative rotation between the camming plug 56 and the bolt 12 when the bolt 12 is rotated in a counterclockwise direction and permit relative rotation between the camming plug 56 and the bolt 12 when the bolt is rotated in a clockwise direction. This arrangement is particularly adaptable in utilizing the expansion shell assembly 10 in a combination with a resin system to securely anchor the bolt 12 in a bore hole drilled in a mine roof. This is accomplished by inserting conventionally known resin cartridges in the bore hole and advancing the cartridges to the end of the hole by a roof bolt 12.

The resin system (not shown) as well known in the art and disclosed in U.S. Pat. Nos. 3,324,662 and 3,394,527 includes a two component resin composition which includes a resin as a first component and a suitable catalyst as a second component. The components are separately stored in a cartridge or package, and a plurality of these cartridges are inserted in tandem position in the bore hole. The cartridges are moved into position in the bore hole by inserting in the bore hole the roof bolt 12 having the expansion shell assembly 10 positioned thereon after the cartridges and advancing roof bolt into the hole. The cartridges are compressed between the end of the bore hole and the end of the roof bolt and fractured to release the resin and catalyst components therefore. Rotation of the bolt 12 and the expansion shell assembly 10 mixes the components to form an essentially homogeneous curable resin mixture. The resin mixture polymerizes and flows downwardly in the bore hole to fill the voids between the shell member 16 and the wall of the bore hole. Thereafter the shell member 16 is expanded and when the resin is cured, the engagement of the shell member 16 with the bore hole wall is substantially increased. Consequently, slippage of the shell mumber 16 in the bore hole is substantially prevented. Thus the tension on the bolt is maintained and is not reduced by slippage of the expanded shell member 16 in the bore hole.

By the addition of the attachment 76 to the expansion shell assembly 10, the assembly 10 is operable as a mixing tool to admix the components of the resin system to form a curable resin mixture. By preventing relative rotation between the camming plug 56 and the bolt 12 when the bolt is rotated, preferably in a counterclockwise direction during the resin mixing operation, the camming plug 56 is prevented from advancing off of the bolt threaded end portion 14. However, the attachment 76 is operable to be released from engagement with the shell member 16 when the bolt 12 is rotated, preferably in a clockwise direction, to expand the fingers 20 of the shell member 16 in the bore hole.

As illustrated in FIGS. 1 and 2, and in greater detail in FIGS. 4–7, the attachment 76 includes a clip member 78 formed by a resilient, generally semicircular portion 80 having outwardly flanged end portions 82 and 84 that facilitate expansion of the resilient portion 80 when the clip member 78 is positioned in surrounding relation with the bolt 12. The semicircular resilient portion 80 is provided with a pair of oppositely positioned apertures 86 and 88 that are operable to receive protrusions 90 and 92 of the bolt 12. The clip member 78 is axially positioned on the bolt 12 in surrounding relation with the protrusions 90 and 92 so that the protrusions extend through the apertures 86 and 88. With this arrangement the clip member 78 is non-rotatably secured and axially fixed to the bolt 12.

A hook portion 94 extends upwardly from the resilient portion 80 and includes a lower end 96 that extends upwardly at an angle away from the resilient portion 80 and a substantially vertically extending upper end 98 that terminates in an in-turned end portion 100. With this arrangement when the clip member 78 is positioned on the bolt 12, the hook portion 94 is arranged to extend from beneath the shell member 16 and upwardly in spaced relation thereto opposite the ring end portion 18 to permit the in-turned end portion 100 to extend into one of the longitudinal slots separating the fingers 20 of the shell member 16.

Preferably, the clip member 78 is attached to the bolt 12 so that the in-turned end portion 100 extends into one of the diametrically opposed slots 26 or 28 as illustrated in FIGS. 1 and 2. However, it will be apparent from the present invention that the end portion 100 is operable to be positioned in any slot that is not obstructed by the strap 66 in a releasable manner as will be explained later in greater detail. Further, it will be apparent from the present invention that the attachment 76 is adaptable with expansion shells known in the art and is not limited to use with the particular expansion shell illustrated in FIGS. 1 and 2.

Figure 6:
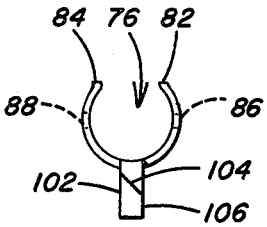
FIG. 6 is a plan view of the clip member taken along line VI—VI of FIG. 5, illustrating an angled camming surface of the end of the hook portion to permit disengagement of the clip member from the shell upon rotation of the bolt in a preselected direction.
Figure 7:
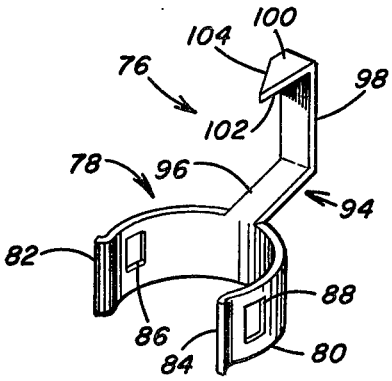
FIG. 7 is an isometric view of the clip member, illustrating a semicircular resilient portion for engaging the shank of the bolt and the hook portion extending upwardly at an angle from the resilient portion.
Figure 8A:
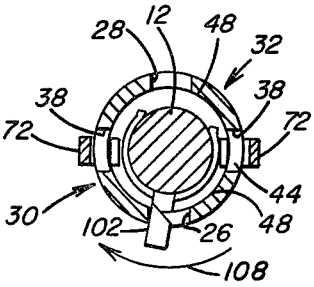
FIG. 8-A is a sectional view taken along line VIII—VIII of FIG. 2, illustrating rotation of the bolt in a first direction to engage the clip member to the shell to prevent relative rotation between the camming plug and the bolt when the bolt is rotated in a bore hole for mixing adhesive material in the bore hole prior to expansion of the shell.
Figure 8B:
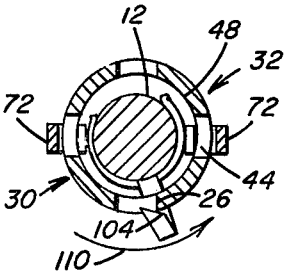

The in-turned end portion 100 has a preselected configuration to facilitate engagement with the shell member 16 to prevent relative rotation between the camming plug 56 and the bolt 12 when the bolt is rotated in a first direction and to permit release of the clip member 78 from engagement with the shell member 16 to permit relative rotation between the camming plug 56 and the bolt 12 when the bolt is rotated in a second direction. To this end the end portion 100 includes a planar abutment surface 102 which is operable to engage the shell member 16, as illustrated in FIG. 8-A, and a camming surface 104 which is operable to contact the shell member 16 and move the in-turned end portion 100 out of the slot 26. The camming surface 104, as illustrated in FIGS. 6 and 7, extends at an acute angle from the end of the abutment surface 102 to a surface 106 positioned parallel to the abutment surface 102.

The attachment 76 in its normally assembled position on the bolt 12 positions the in-turned end portion 100 in one of the longitudinal slots 26 or 28 adjacent the closed end portion 34 thereof. The attachment 76 is maintained in this position when the expansion shell assembly 10 on the bolt 12 is inserted in the bore hole of the mine roof. As stated hereinabove, the cartridges containing the resin system used in combination with the expansion shell assembly 10 are placed in the bore hole in advance of the assembly 10. The resin system utilized is well known in the art of reinforcing underground formations, tunnels, excavations, faults and the like in rock structure. Further, it is well known to utilize a resin system to strengthen such formations by bonding a roof bolt, reinforcing rod and the like to a bore hole wall in a rock formation.

A suitable resinous composition is disclosed in U.S. Pat. Nos. 3,324,662 and 3,394,527 where the resin system includes two components separately packaged in a polyethylene cartridge. Each cartridge includes a first compartment containing a thixotropic resin. A conventional catalyst is contained in a second compartment of the cartridge. The thixotropic nature of the resin material permits the two components when mixed to remain in place temporarily during the curing of the mixture without flowing out of the vertical bore hole.

In accordance with the method of the present invention, when the cartridges are positioned in the bore hole between the end of the expansion shell assembly 10 on the bolt 12 and the end of the bore hole, the bolt is thrust upwardly to rupture the cartridges to permit mixing of the resin components. Thereafter the bolt is rotated in a first direction, as illustrated in FIG. 8-A, which is preferably a counterclockwise direction when viewed upwardly from the end of the bolt emerging from the bore hole. In this manner the resin components are released in the bore hole. Rotation of the assembly 10 and bolt 12 thoroughly mixes the resin and catalyst components to form an essentially homogeneous curable resin mixture. Rotating the bolt in a counterclockwise direction urges the abutment surface 102 in the clip member 78 into abutting relation with the edge of the adjacent finger 20. The clip member 78 thus becomes engaged with the shell member 16 as long as the bolt is rotated in the direction indicated by arrow 108 in FIG. 8-A, and the camming plug 56 is prevented from rotating relative to the bolt 12. In this manner the camming plug is retained on the threaded end portion 14 of the bolt 12 during mixing of the resin components.

With the clip member non-rotatably secured and axially fixed to the bolt 12, engagement of the clip member 78 to the shell member 16 by contact of the abutment surface 102 with a finger 20 exerts a downward force upon the shell member 16. This arrangement restrains the shell from moving longitudinally off of the bolt threaded end portion 14. Because the shell member 16 is connected to the camming plug 56 by the strap 66, the strap 66 is also restrained from movement off the bolt end portion 14. Therefore, when the bolt 12 is rotated in a counterclockwise direction in the bore hole, the camming plug 56 is prevented from threading off the bolt end portion 14.

With this arrangement it is possible to rotate the expansion shell assembly 10 in a counterclockwise direction in the bore hole to effect mixing of the resin components comprising the resin system at a location surrounding the assembly 10 in the annulus between the assembly 10 and the bore hole wall. The mixture may also flow into fissures and faults of the rock strata communicating with the bore hole. The bolt 12 is rotated in a counterclockwise direction until the resin components are thoroughly mixed but before the resin system sufficiently polymerizes to prevent rotation of the bolt 12, Before this stage is reached the direction of rotation of the bolt 12 is reversed to the direction indicated by the arrow 110 in FIG. 8-B which preferably is rotation in a clockwise direction as viewed upwardly from the end of the bolt extending out of the bore hole.

Clockwise rotation of the bolt 12 urges the camming surface 104 of the hook portion 94 into contact with the side edge of the adjacent finger 20. As the camming surface 104 contacts the finger 20 the inclination of the camming surface 104 permits the in-turned end portion 100 to move out of the slot 26 to the extent that the clip member 78 becomes disengaged from the shell member 16. Consequently, the shell member 16 is no longer secured to the bolt 12 by the clip member 78, and the camming plug 56 is free to rotate relative to the bolt 12. Rotation of the bolt 12 in a clockwise direction advances the camming plug 56 downwardly on the bolt 12. With the configuration of the shell member 16 as illustrated in FIGS. 1 and 2, the shell halves 30 and 32 initially expand uniformly as units before the individual fingers expand in a manner as disclosed in greater detail in United States Patent Application Serial No.

The camming plug 56 continues to move downwardly on the bolt 12 as it is rotated until the fingers 20 have been wedged into engagement with the bore hole wall and the resin system surrounding the shell member 16 and adhering to the bore hole wall. When the fingers 20 have become completely wedged in the bore hole, the shell 10 is set and further downward movement of the camming plug 56 is prevented. During the expansion stage of the assembly 10, the viscosity of the mixed resin permits rotation of the bolt 12 and expansion of the shell member 16. In this manner a tension is exerted on the bolt and is substantially maintained by anchoring the bolt through the engagement provided by the expanded shell member 16 and the cured resin filling the voids between the shell member and the bore hole wall.

Rotation of the bolt 12 for the period of time required to set the expansion shell assembly 10 ensures complete mixing of the resin components. Once the assembly 10 is set in the bore hole, the resin system polymerizes. The resin mixture cures so that the portions of the shell fingers 20 not engaged to the bore hole wall are bonded thereto by the resin filling the annulus between the shell member 16 and the bore hole wall. In this manner an increased area of frictional engagement is provided between the shell member 16 and the bore hole wall.

Thus it will be apparent that the present invention facilitates the combined use of bonding a roof bolt to a bore hole wall and anchoring the roof bolt in a bore hole by expansion of a shell into gripping engagement with the bore hole wall. By filling the bore hole surrounding the expansion shell assembly with a resin composition, increased engagement of the shell member 16 is provided with the wall of the bore hole. In comparison with a conventional expansion shell where the fingers are frictionally engaged by a relatively narrow portion of the fingers to the bore hole wall, the area of frictional engagement of the fingers with the bore hole wall of the present invention is substantially increased by the addition of a resin system in surrounding relation with the expansion shell in the bore hole. Consequently, by increasing the area of frictional engagement of the expansion shell with the bore hole wall, the loss of tension in the bolt because of slippage between the expanded shell and the bore hole wall is substantially reduced. Furthermore, the resin fills a substantial portion of the bore hole surrounding the bolt 12 and is instrumental in resisting forces that normally apply shear stresses to the rock formation.

When the expansion shell 10 is anchored in the bore hole and the bearing surface of the roof plate is in contact with the face of the rock formation surrounding the bore hole, continued rotation of the bolt increases the tension in the bolt as a result of the supporting force exerted upon the surface of the rock formation by the roof plate. The bolt may be tensioned to a preselected magnitude to apply a preselected compression upon the layers of the rock strata to reinforce the rock strata. This arrangement is operable to prevent shearing apart of the overlying layers of the strata and failure of the rock formation and collapse of the mine roof. The presence of the resin system serves to prevent slippage of the expansion shell in the bore hole so that when the bolt is tensioned by operation of the expansion shell assembly 10, loss of tension in the bolt resulting from slippage of the expanded shell assembly in the bore hole is substantially reduced.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. An expansion shell assembly for anchoring a bolt in a bore hole containing adhesive material comprising, a camming plug threadably engaged to the end of the bolt for axial movement thereon, an expandable shell having a plurality of longitudinally extending fingers spaced from one another by longitudinal slots, said fingers each having an inner surface abutting said camming plug and an outer surface adapted to engage the wall of the bore hole, releasable means securing said camming plug to the bolt for rotating the bolt in a first direction to facilitate mixing of the adhesive material in the bore hole, and said releasable means being operable upon rotation of the bolt in a second direction to permit rotation of the bolt relative to said camming plug and effect advancement of said camming plug on the bolt to exert an outward force upon said inner surfaces of said fingers to expand said fingers in the bore hole and thereby tension the bolt.

2. An expansion shell assembly as set forth in claim 1 in which, said releasable means includes means for releasing said shell from connection with the bolt to permit relative rotation between said camming plug and the bolt.

3. An expansion shell assembly as set forth in claim 1 which includes, said releasable means being operable to non-rotatably connect said camming plug to the bolt for rotation of said camming plug with the bolt in a counterclockwise direction viewed upwardly into the bore hole.

4. An expansion shell assembly as set forth in claim 1 which includes, said releasable means having means for releasing said camming plug from non-rotatable relation with the bolt upon rotation of the bolt in a clockwise direction viewed upwardly into the bore hole to permit axial movement of said camming plug on the bolt.

5. An expansion shell assembly as set forth in claim 1 which includes, engaging means for maintaining said camming plug in assembled relation with said shell, said engaging means being secured to said shell so that said engaging means rotates with said shell, said releasable means being non-rotatably connected to the bolt and engageable with said shell to prevent relative rotation between said camming plug and the bolt upon rotation of the bolt to mix the adhesive material in the bore hole, and said releasable means being releasable from engagement with said shell to permit relative rotation between said camming plug and the bolt upon rotation of the bolt to expand said fingers into contact with the wall of the bore hole and the adhesive material therein.

6. An expansion shell assembly as set forth in claim 1 which includes, said releasable means including a clip member having a first portion adapted for non-rotatable connection to the bolt and a second portion extending between a pair of said fingers into one of said slots, said clip member second portion being arranged for releasable engagement with said shell, said clip member second portion having an abutment surface and a camming surface, said abutment surface being movable upon counterclockwise rotation of the bolt into abutting relation with one of said pairs of fingers to prevent relative rotation between said camming plug and the bolt, and said camming surface being movable upon clockwise rotation of the bolt relative to the opposite one of said pair of fingers to disengage said clip member second portion from said shell to permit relative rotation between said camming plug and the bolt.

7. An expansion shell assembly as set forth in claim 1 which includes, engaging means for maintaining said camming plug in assembled relation with said shell, said releasable means including a clip member having a hook portion extending into a longitudinal slot between a pair of said fingers and engaging said shell and a resilient portion adapted to engage the bolt, said clip member hook portion being operable upon counterclockwise rotation of the bolt to maintain said camming plug non-rotatably mounted relative to the bolt and upon clockwise rotation of the bolt to disengage said shell to permit relative rotation between said camming plug and the bolt, and said resilient portion having means for non-rotatably securing said clip member to the bolt.

8. Method for supporting a rock formation comprising, inserting an adhesive material in a bore hole of a rock formation, advancing an elongated bolt member having an expansion shell assembly positioned on the end thereof into the bore hole, rotating the bolt member in a first direction to effect mixing of the adhesive material in the bore hole, and thereafter rotating the bolt member in a second direction to effect expansion of the expansion shell assembly in the bore hole to tension the bolt member and thereby securely anchor the bolt member to the rock formation.

9. Method for supporting a rock formation as set forth in claim 8 which includes, maintaining the expansion shell assembly in assembled relation on the end of the bolt member to facilitate rotation of the bolt member in the first direction for mixing of the adhesive material in the bore hole.

10. Method for supporting a rock formation as set forth in claim 8 which includes, securing a camming plug by a releasable means to the bolt member for rotation with the bolt member, rotating the bolt member with the camming plug secured thereto in the first direction to facilitate mixing of the adhesive material in the bore hole, and rotating the bolt member in the second direction to release the releasable means and permit rotation of the bolt member relative to the camming plug.

11. Method for supporting a rock formation as set forth in claim 8 which includes, filling substantially all the voids between the expansion shell assembly and the wall of the bore hole with the mixed adhesive material by rotation of the bolt member in the first direction, and tensioning the bolt member after mixing of the adhesive material in the bore hole upon rotation of the bolt member in the second direction.

12. Method for supporting a rock formation as set forth in claim 8 which includes, positioning a roof plate on the end of the bolt member externally of the bore hole, and rotating the bolt member after mixing the adhesive material in the bore hole in the second direction to expand the expansion shell assembly in the bore hole and urge the roof plate into contact with the surface of the rock formation to exert a tension on the bolt.

13. Method for supporting a rock formation as set forth in claim 8 which includes, rotating the bolt member in the first direction to position the mixed adhesive material in the voids between the expansion shell assembly and the wall of the bore hole, filling the bore hole surrounding a substantial portion of the bolt member with the mixed adhesive material, rotating the bolt member in the second direction to expand the expansion shell assembly in the bore hole and tension the bolt member, and maintaining the tension on the bolt by securing the expanded shell assembly in the bore hole by the addition of the adhesive material and thereby preventing slippage of the expanded shell assembly in the bore hole.

* * * * *

Notice of Adverse Decision in Interference

In Interference No. 100,743, involving Patent No. 4,160,614, S. F. Koval, EXPANSION SHELL ASSEMBLY AND METHOD FOR COMBINING RESIN BONDING AND MECHANICAL ANCHORING OF A BOLT IN A ROCK FORMATION, final judgment adverse to the patentee was rendered Mar. 11, 1983, as to claims 1–4, 6 and 9–13.

[*Official Gazette June 14, 1983.*]